US005105497A

United States Patent [19]

Haque

[11] Patent Number: 5,105,497

[45] Date of Patent: Apr. 21, 1992

[54] ELECTRIC ERASER

[76] Inventor: Ekramul Haque, 1300 Frontier La., Manhattan, Kans. 66502

[21] Appl. No.: 649,985

[22] Filed: Feb. 4, 1991

[51] Int. Cl.[5] ..... A47L 5/24

[52] U.S. Cl. ..... 15/3.53; 15/301; 15/344; 15/353

[58] Field of Search ..... 15/3.53, 301, 344, 353

[56] References Cited

U.S. PATENT DOCUMENTS

| | | | |
|---|---|---|---|
| 2,406,487 | 8/1946 | Brewer | 15/3.53 |
| 2,956,546 | 10/1960 | Teters et al. | 15/3.53 |
| 3,548,436 | 12/1970 | Henrich | 15/3.53 |
| 3,774,255 | 11/1973 | Pao | 15/3.53 |
| 5,018,238 | 5/1991 | Nelle | 15/344 X |

*Primary Examiner*—Chris K. Moore

[57] ABSTRACT

An improved electric eraser that prevents crumbs from scattering, confines them in a small area around the rotating eraser, and collects crumbs in a removal container simultaneously while erasing, consisting of a suction pipe to prevent crumbs from scattering, confine crumbs to a small area around the rotating eraser, and suck the crumbs; a removable container to collect the crumbs in; a baffle to deflect and force the crumbs to settle in the container; a centrifugal fan to produce suction; an enclosure for the centrifugal fan to provide an appropriate outlet area for the sucked air; an electric motor to run the centrifugal fan; a power means; and a switching means. The suction produced by the centrifugal fan forces and transports the eraser crumbs through the suction pipe to the baffle where the crumbs are deflected, lose the momentum, and are forced to settle in the removable container for final disposal.

1 Claim, 3 Drawing Sheets

ELECTRIC ERASER

BACKGROUND OF THE INVENTION

1. Field of the Invention

This invention relates to an apparatus for confining, and collecting crumbs of electric erasers. More particularly, the present invention is concerned with a mechanized apparatus for preventing crumbs of electric erasers from scattering and confining crumbs in a small area around the rotating eraser; and vacuum collecting crumbs in a container integral to the apparatus for final disposal.

Existing electric erasers generally consist of a vertical fast rotating hollow shaft with a cylindrical eraser mounted at the bottom end of the shaft by using a detachable chuck. The entire assembly along with the eraser is rotated by an electric motor mounted at the top end of the machine. During the erasing process the crumbs that originate on the paper are thrown outwards from the erasing points by the centrifugal force and consequently the crumbs are scattered in all directions. The crumbs are then, intermittently brushed off or manually collected for disposal.

Eraser crumbs are nuisance particulates that pervade drafting areas used by draftsmen, engineers, artists, and students who use electric erasers frequently. Electric erasing process generate crumbs that make the papers, tables, floors, and other places dirty.

2. Description of Prior Art

Appropriate mechanized apparatus for preventing crumbs from scattering, confining them in a small area around the rotating eraser, and collecting crumbs of electric erasers has not yet been invented. However, relatively large dust collection systems are widely used in many household, commercial, and industrial applications. Such devices are being used for many decades. Household and commercial applications include vacuum cleaners; and industrial usage includes cyclone and filter type dust collection system individually or in combination. These devices are extremely large compared to the apparatus in this invention; and neither they are suitable nor intended for confining and collecting eraser crumbs from a small surface like a piece of paper. Present crumb collection inventions consist of bulky, unweildy, and inconvenient devices that neither can prevent crumbs from scattering nor are capable of collecting crumbs simultaneously during the erasing process.

Existing process of disposing electric eraser crumbs consists of brushing or sucking them away after they are formed or manually collecting them in various containers before final disposal. These solutions are far from desirable but they are the only practical and workable methods available at present. In the event when the crumbs are brushed away, they usually fall on the floors making the floors dirty. In case of thickly carpeted floors, the crumbs could penetrate deep into the carpets making it difficult for the vacuum cleaners to pick them up. Eraser crumbs catch on clothes and furniture; and create an ugly sight, a dirty and unhealthy living and working conditions.

What is needed is to design a mechanized apparatus capable of 1) preventing the crumbs from scattering on the paper and confining them in a small collection area around the rotating eraser; and 2) collecting the crumbs simultaneously during erasing in a container integral to the apparatus for final disposal. This would involve development of an apparatus which could easily be incorporated to an existing electric eraser. A desirable and convenient apparatus should be small and light weight.

SUMMARY OF THE INVENTION

The problems outlined above are in large measures solved by "Improved Electric Eraser" in accordance with the present invention. That is to say, the apparatus serves a very useful function; is of appropriate design, and convenience; and requires only household electric power source to operate. It could be used by almost everybody in the world who uses electric erasers.

The apparatus in accordance with the present invention broadly includes a small suction pipe surrounding the vertical eraser and the eraser chuck so as to prevent the crumbs from scattering and to confine them in a small area around the eraser thereby facilitating the suction and transport of the crumbs to a collection point within the apparatus; a baffle to reduce the momentum of the crumbs and to force them to settle; a backwardly curved-vane centrifugal fan to cause suction of the crumbs; an enclosure for the fan to provide an appropriate air-outlet area; a motor to run the fan as well as the eraser; and a switch to put the motor on or off.

DETAILED DESCRIPTION OF THE INVENTION

Figure 1:
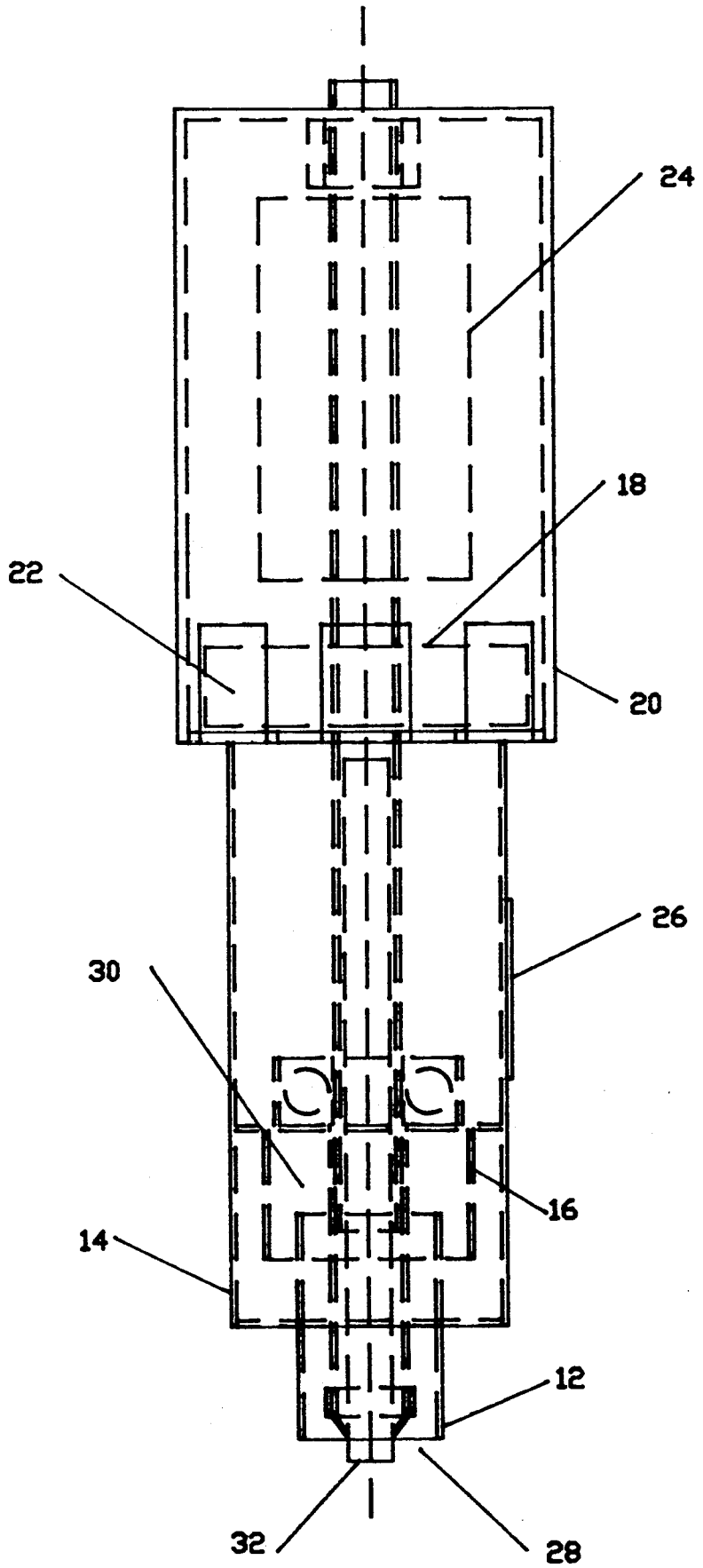
FIG. 1 is a front elevational view of the apparatus.
Figure 2:
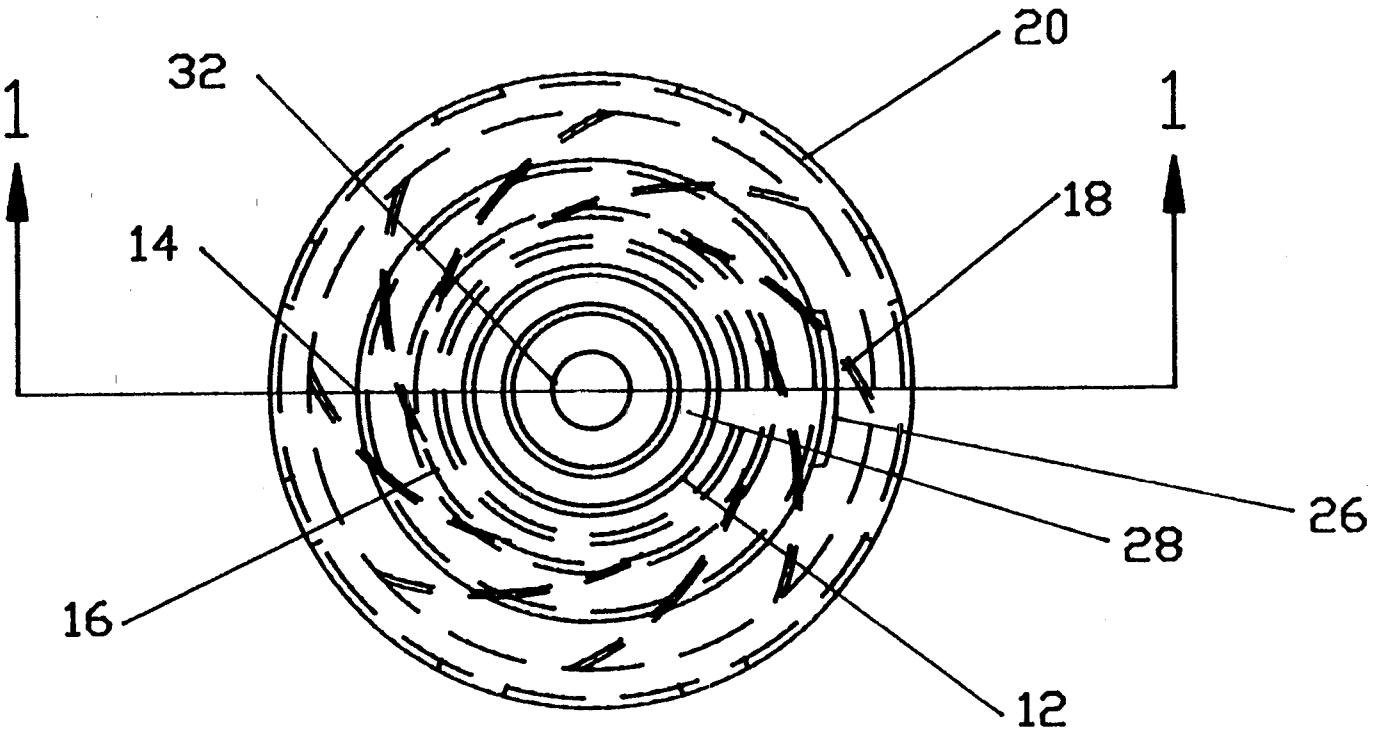
FIG. 2 is a bottom view of the apparatus as viewed from the bottom of FIG. 1.
Figure 3:
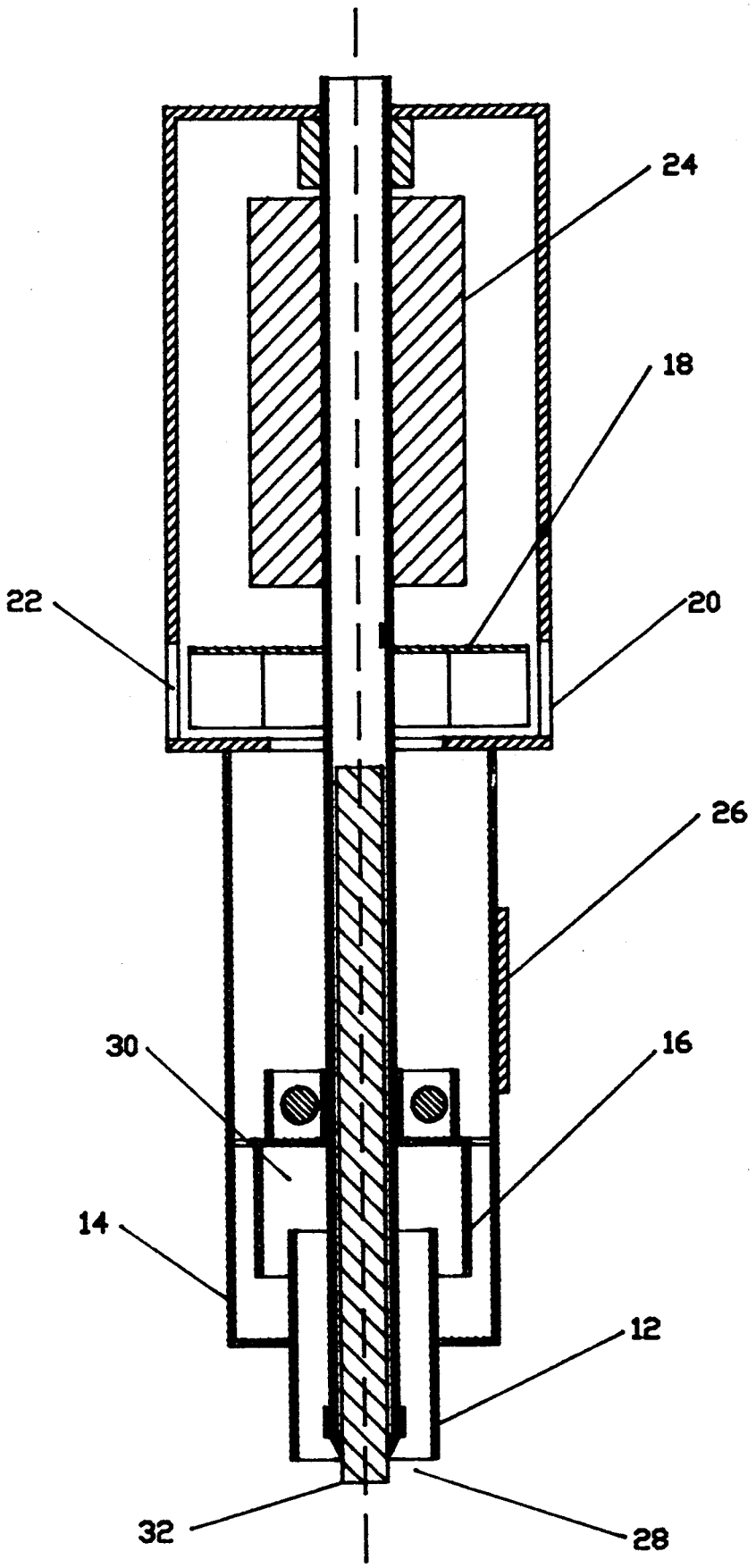
FIG. 3 is a sectional view taken along the line 1—1 of FIG. 2.

Referring now to the drawings in FIG. 1, FIG. 2, and FIG. 3; improved electric eraser; in accordance with the invention broadly includes a suction pipe 12; a container 14; a baffle 16; a backwardly curved-vane centrifugal fan 18; an enclosure 20, for the fan to provide appropriate outlet openings 22; a motor 24; and an on-off switch 26.

When the switch 26, of the apparatus is put "on", the motor 24, is energized; the eraser 32, and the centrifugal fan 18, rotate at a high speed; the centrifugal fan 18, creates suction through the apparatus. The crumbs of the electric erasers are introduced into the nozzle opening 28, immediately after the formation of the crumbs. From the nozzle opening 28, the eraser crumbs are pneumatically picked up through the suction pipe 12, by the low pressure and high velocity air. After the eraser crumbs enter into the space 30, above the suction pipe the crumbs laden air is deflected by the baffle 16. The crumbs lose their momentum due to impact on the baffle 16, upto an extent that thereafter, the force of gravity becomes more predominant and makes the crumbs settle into the removal container 14, fixed integrally with the suction pipe 12. The air which is sucked up by the centrifugal fan 18, does not posses enough velocity to keep the crumbs airborne. Consequently, only clean air passes through the centrifugal fan 18, out through the openings 22, located along the periphery of the enclosure 20, of the fan. The power of the motor 24, is obtained from a household electric power supply.

I claim:

1. An improved electric eraser for preventing crumbs from scattering, confining them in a small area around the rotating eraser, and collecting crumbs while the electric eraser is in use comprising:

an electric motor with its axis substantially positioned vertically;

a shaft mounted on the motor with its axis collinear with axis of the motor, and driven by the motor;

an eraser mounted on the bottom end of said shaft for rotation therewith;

a container assembly comprising:

a suction pipe of cylindrical shape and of a first inner diameter, said suction pipe being open at both ends and having a generally vertical axis and a peripheral surface, said vertical axis being colinear with the axis of rotation of the eraser, said first inner diameter being large enough to provide adequate space around the rotating eraser so as to allow passage for the crumbs and the air to flow upward;

a container of a cylindrical shape and of a second inner diameter concentrically surrounding said suction pipe and providing an annular space between said suction pipe and said container, said annular space being closed at the bottom, the bottom of said annular space being at a higher elevation level than the bottom of said suction pipe;

a baffle of a cylindrical shape and of a third inner diameter concentrically surrounding said suction pipe at a midway location of said annular space, said baffle being open at the bottom which terminates at an elevation level below the elevation level of the top end of said suction pipe, said baffle resembling an inverted cup with a hole at the center of the bottom of said cup, the bottom of said cup being at an elevation level substantially above the elevation level of the top end of said suction pipe;

a centrifugal fan having a fan rotor of a fourth diameter and of a backwardly curved-vane type with the vane facing downward, said fan rotor being mounted on said shaft near the lower end of said motor, the axis of said fan rotor and the axis of said motor being the same;

an enclosure for said centrifugal fan to provide an air inlet and an appropriate air-outlet area, said enclosure having a cylindrical shape and surrounding said fan rotor, said enclosure being of a fifth diameter marginally larger than the fourth diameter and providing sufficient clearance between said enclosure and said fan rotor, said enclosure being positioned vertically with its axis in line with the axis of said fan rotor, said enclosure having an air inlet opening centered around said fan rotor axis communicating with said container at the upper end thereof, said enclosure having equidistant slot openings around the periphery for the passage of the air out of the electric eraser, said slot openings being at the same elevation level as said fan rotor;

a power means for supplying power to said electric motor; and a switching means for turning the electric motor on or off.

* * * * *